US005794105A

United States Patent [19]

Tamaoki et al.

[11] Patent Number: 5,794,105

[45] Date of Patent: Aug. 11, 1998

[54] IMAGE FORMING APPARATUS AND TONER FOR FULL COLOR DEVELOPMENT

[75] Inventors: Junichi Tamaoki, Sakai; Ichiro Demizu, Toyonaka; Takeshi Arai; Katsunori Kurose, both of Amagasaki; Masayuki Hagi, Takatsuki; Hiroyuki Fukuda, Kobe, all of Japan

[73] Assignee: Minolta Co., Ltd., Osaka, Japan

[21] Appl. No.: 609,834

[22] Filed: Mar. 1, 1996

[30] Foreign Application Priority Data

| | | | |
|---|---|---|---|
| Mar. 3, 1995 | [JP] | Japan | 7-070889 |
| Mar. 3, 1995 | [JP] | Japan | 7-070890 |
| Mar. 3, 1995 | [JP] | Japan | 7-070891 |
| Mar. 3, 1995 | [JP] | Japan | 7-070892 |

[51] Int. Cl.[6] ..... G03G 9/08; G03G 15/00

[52] U.S. Cl. ..... 399/223; 399/298; 399/302; 399/313; 399/329; 430/109

[58] Field of Search ..... 355/285, 282, 355/290, 245; 430/106–110, 45; 118/647–649; 399/122, 328, 329

[56] References Cited

U.S. PATENT DOCUMENTS

| | | | |
|---|---|---|---|
| 4,590,139 | 5/1986 | Imai et al. | 430/45 |
| 4,657,837 | 4/1987 | Morita et al. | 430/109 |
| 4,933,252 | 6/1990 | Nishikawa et al. | 430/109 |
| 5,035,197 | 7/1991 | Enoguchi et al. | 118/647 |
| 5,102,761 | 4/1992 | Ohsaki et al. | 430/106 |
| 5,126,221 | 6/1992 | Chiba et al. | 430/45 |
| 5,210,580 | 5/1993 | Aslam et al. | 355/290 |
| 5,260,159 | 11/1993 | Ohtani et al. | 430/106.6 |
| 5,272,040 | 12/1993 | Nasakawa et al. | 430/110 |
| 5,300,383 | 4/1994 | Tsubota et al. | 430/45 |
| 5,314,773 | 5/1994 | Kubo et al. | 430/45 |
| 5,370,958 | 12/1994 | Shin et al. | 430/110 |
| 5,465,146 | 11/1995 | Higashi et al. | 355/285 |
| 5,567,563 | 10/1996 | Minami | 430/110 |
| 5,650,484 | 7/1997 | Hawkins et al. | 430/109 |

*Primary Examiner*—Arthur T. Grimley
*Assistant Examiner*—Quana Grainger
*Attorney, Agent, or Firm*—Burns, Doane, Swecker & Mathis, LLP

[57] ABSTRACT

A toner for full-color development for use in a developing system of a full-color image forming apparatus which comprises a binder resin having a glass transition point Tg of from 60° to 75° C., a number-average molecular weight Mn of from 3500 to 6000, a ratio of a weight-average molecular weight Mw to the number-average molecular weight Mn (Mw/Mn) ranging from 3 to 8, and a difference between a temperature $T_1$ at the apparent melt viscosity of $1\times10^5$ poise and a temperature $T_2$ at the apparent melt viscosity of $1\times10^6$ poise DT ($=T_1-t_2$) in the range of from 8° to 15° C.

47 Claims, 2 Drawing Sheets

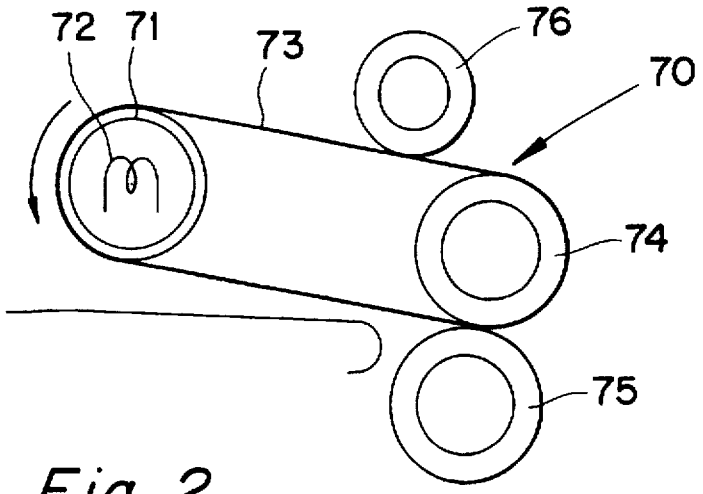
Fig. 2
Fig. 3
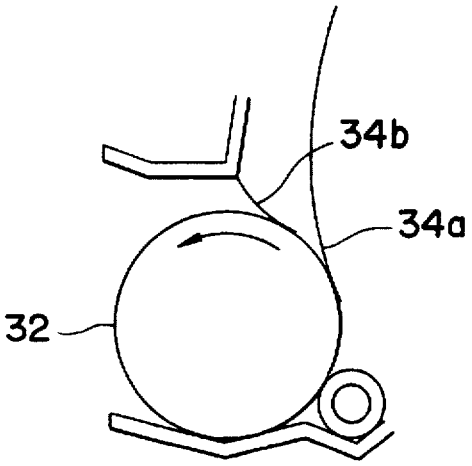

IMAGE FORMING APPARATUS AND TONER FOR FULL COLOR DEVELOPMENT

BACKGROUND OF THE INVENTION

1. Field of the Invention

The present invention relates to a full-color image forming apparatus such as a full-color copier, a full-color printer or the like, and a toner for use in the same.

2. Description of the Related Arts

Conventionally, there have been widely used image forming apparatus utilizing the electrophotographic system which include copiers, printers and facsimiles. The electrophotographic system performs the image forming operations which comprise the steps of forming an electrostatic latent image on a photoconductive drum, developing the latent image into a toner image by the use of a toner material, and transferring the toner image onto a receiving material such as copy paper. In recent years, full-color image forming apparatus such as full-color copiers and full-color printers have been spreading. The full-color image forming apparatus is adapted to develop a full-color image by the use of a toner of multiple colors.

Such full-color image forming apparatus include a variety of systems. For example, one system comprises the steps of: causing writing means to irradiate light beams such as laser beams onto a charged photoconductive drum thereby forming an electrostatic latent image thereon corresponding to a specific color; developing the electrostatic latent image into a toner image by feeding thereto a toner of a corresponding color selected from the group consisting of a magenta toner, a cyan toner, a yellow toner and, if required, a black toner; transferring the resultant toner image onto a receiving material such as a copy sheet which is held on an intermediate transfer body; cyclically repeating the aforementioned steps of forming, developing and transferring of an image for the respective colors so as to superimpose the toner images of the respective colors on a copy sheet thereby obtaining a full-colored toner image; and then fixing the resultant toner image onto a copy sheet. An alternative system includes the steps of: forming an electrostatic latent image corresponding to a specific color in the foregoing manner, feeding thereto a toner of a corresponding color selected from the group consisting of a magenta toner, a cyan toner, a yellow toner and, if required, a black toner, thereby developing it into a toner image; transferring the toner image thus obtained onto an intermediate transfer body; cyclically repeating the aforesaid steps of forming, developing and transferring of an image for the respective colors so as to superimpose the toner images of the respective colors on an intermediate transfer body for obtaining a full-colored toner image; transferring the resultant full-colored toner image from the intermediate transfer body to a copy sheet; and fixing the toner image on the copy sheet.

The aforesaid full-color image forming apparatus generally employs a two-component type developing unit for feeding a toner to an electrostatic latent image formed on the photoconductive drum. The toner used by this unit comprises a toner and a carrier. The image forming apparatus incorporates four such developing units accommodating a cyan developer comprising a mixture of a cyan toner and a carrier, a magenta developer comprising a mixture of a magenta toner and a carrier, a yellow developer comprising a mixture of a yellow toner and a carrier and a black developer comprising a mixture of a black toner and a carrier respectively, for independent image development.

The two-component type developing unit utilizing a mixture of a toner and a carrier is adapted to be replenished with toner to make up for the toner consumed for development of an image. However, it keeps using the carrier with no replenishment thereof, and therefore, the carrier becomes spent as gradually defiled by toner ingredients. This leads to the deterioration of the carrier, which means a reduced chargeability of the toner, and hence, an image to be formed is adversely affected.

Additionally, the two-component type developing unit requires a mechanism for mixing by stirring a toner and a carrier, which makes it difficult to downsize the unit. Especially, the full-color image forming apparatus including four such developing units must be large in size and requires the more costs. Particularly recently when a desire for a full-color image forming apparatus for personal use is increasing, a strong demand exists for a full-color image forming apparatus smaller in size and less costly.

In this connection, consideration has recently been given to the use of a one-component type developing unit utilizing a developer with no carrier, which is to replace the aforesaid two-component type developing unit utilizing a mixture of a toner and a carrier. The problem of carrier deterioration may be solved by the one-component type developing unit. Additionally, a smaller developing unit allows the downsizing and cost reduction of the full-color image forming apparatus.

The one-component type developing unit includes a system utilizing a magnetic toner and that utilizing a non-magnetic toner. In the case of the magnetic toner, a black magnetic powder is normally added to the toner material. With the magnetic powder added thereto, the resultant color toners, such as cyan toner, magenta toner, yellow toner and black toner, have reduced color. If such color toners are used to form a full-color image, the resultant image suffers poor color definition.

In the one-component type developing unit employing the non-magnetic toner, a toner regulating member such as of blade is typically pressed against a developer sleeve transporting the toner to the photoconductive drum so as to regulate an amount of toner on the developer sleeve while charging the toner.

A typical full-color toner used in the art is a sharp-melting toner which is quickly melted and fixed in the fixing process so as to enhance the transparency and color mixability of an image to be formed. If such a toner is used in the aforesaid developing unit, the toner material is subject to stress from the toner regulating member pressed against the developer sleeve, and thus is set as agglomerate on the toner regulating member and the developer sleeve.

Additionally, the toner of this type does not provide sufficient fixing, resulting in a reduced adhesion to a copy sheet. This also leads to the occurrence of offsets.

In a current image forming apparatus utilizing the one-component type developing unit, the foregoing developing unit as well as a photoconductive drum and a cleaning unit are integrated into a cartridge. Such a cartridge allows an even further downsizing and cost reduction of the image forming apparatus. Additionally, an ordinary user can readily replenish the toner by exchanging cartridges.

A cartridge integrating the developing unit of the aforesaid full-color image forming apparatus may sometimes be stored at high ambient temperatures. Accordingly, good heat resistance is required of the cartridge such that the toner loaded in the developing unit may not be deteriorated by heat.

A transfer system for transferring a toner image formed on a photoconductive drum is disclosed in Japanese Unexamined Patent Publication No. 59-46664 (1984). The transfer system is arranged such that a transfer roller applied with a bias voltage is brought into contact against the photoconductive drum so that a copy sheet is passed between the transfer roller and the photoconductive drum for transferring by pressure the toner image from the photoconductive drum to the copy sheet. This transfer system advantageously minimizes the occurrence of mistimed transport of a copy sheet or transfer drift, and also allows downsizing of an image forming apparatus with a shorter transport path of copy paper and smaller photoconductive drum.

In this transfer system, however, the transfer roller is pressed against the photoconductive drum with a toner image formed thereon, forcing the toner into adhesion to the photoconductive drum. This leads to a defective transfer of toner onto copy paper, particularly to the central portion of an image area, and thus occur white spots in the image area.

In the aforesaid full-color image forming apparatus employing such a transfer system, the toners of magenta, cyan, yellow and, as required, black are transferred individually to superimpose toner images of the respective colors for producing a full-color image. Accordingly, white spots are more likely to occur in an image area due to the defective transfer of toner as described above. Particularly if toner images of the respective colors are transferred by pressure onto the intermediate transfer body from which the toner images are further transferred by pressure onto a copy sheet, white spots also occur during transfer of the toner images from the intermediate transfer body to the copy sheet, and hence the resultant image contains the more white spots therein.

SUMMARY OF THE INVENTION

The present invention is directed to solve the aforesaid problems of the full-color image forming apparatus such as full-color copiers and full-color printers, and of the toner for full-color development for use in such apparatus.

An object of the invention is to prevent a toner for full-color development for use in the full-color image forming apparatus from being set as agglomerate on the toner regulating member and the developer sleeve when it is regulated in the amount and charged by the toner regulating member, and to prevent the same from being deteriorated by heat, the toner amount regulating member performing the toner regulation and charging operations as pressed against the developer sleeve for transporting the toner to the photoconductive drum.

Another object of the invention is to assure for a long time the production of an excellent full-color image with no white spots therein by providing successful transfer by pressure of a toner image onto the intermediate transfer body or the receiving material.

Yet another object of the invention is to provide a toner for full-color development exhibiting a sufficient strength and adhesion such that the toner fast adheres to the receiving material when a toner image is fixed onto the receiving material as pressed between a fixing belt trained about a roller and a pressure roller pressed against the aforesaid roller via the fixing belt, whereby assuring the production of an excellent full-color copy suffering less toner separation from a folded receiving material and less off-sets.

A toner for full-color development according to the present invention comprises a colorant and a binder resin having a glass transition point Tg of from 60° to 70° C., a number-average molecular weight Mn of from 3500 to 6000, a ratio of a weight-average molecular weight Mw to the number-average molecular weight (Mw/Mn) ranging from 3 to 8, and a difference $DT(=T_1-T_2)$ between a temperature $T_1$ at the apparent melt viscosity of $1\times10^5$ poise and a temperature ($T_2$) at the apparent melt point viscosity of $1\times10^6$ poise in the range of from 8° to 15° C.

A full-color image forming apparatus according to the present invention should employ the aforesaid toner for full-color development, as a developer for use in the developing unit thereof.

It is to be understood that the object and form of the present invention should not be limited to those described herein and that various changes may be resorted to without departing from the spirit of the invention or the scope of the claims set forth herein.

BRIEF DESCRIPTION OF THE DRAWINGS

FIG. 2 is a schematic figure for illustrating a fixing unit incorporated in the full-color image forming apparatus of FIG. 1; and FIG. 3 is a schematic figure for illustrating a portion of a full-color developing unit incorporated in the full-color image forming apparatus of FIG. 1.

DESCRIPTION OF THE PREFERRED EMBODIMENTS

Figure 1:
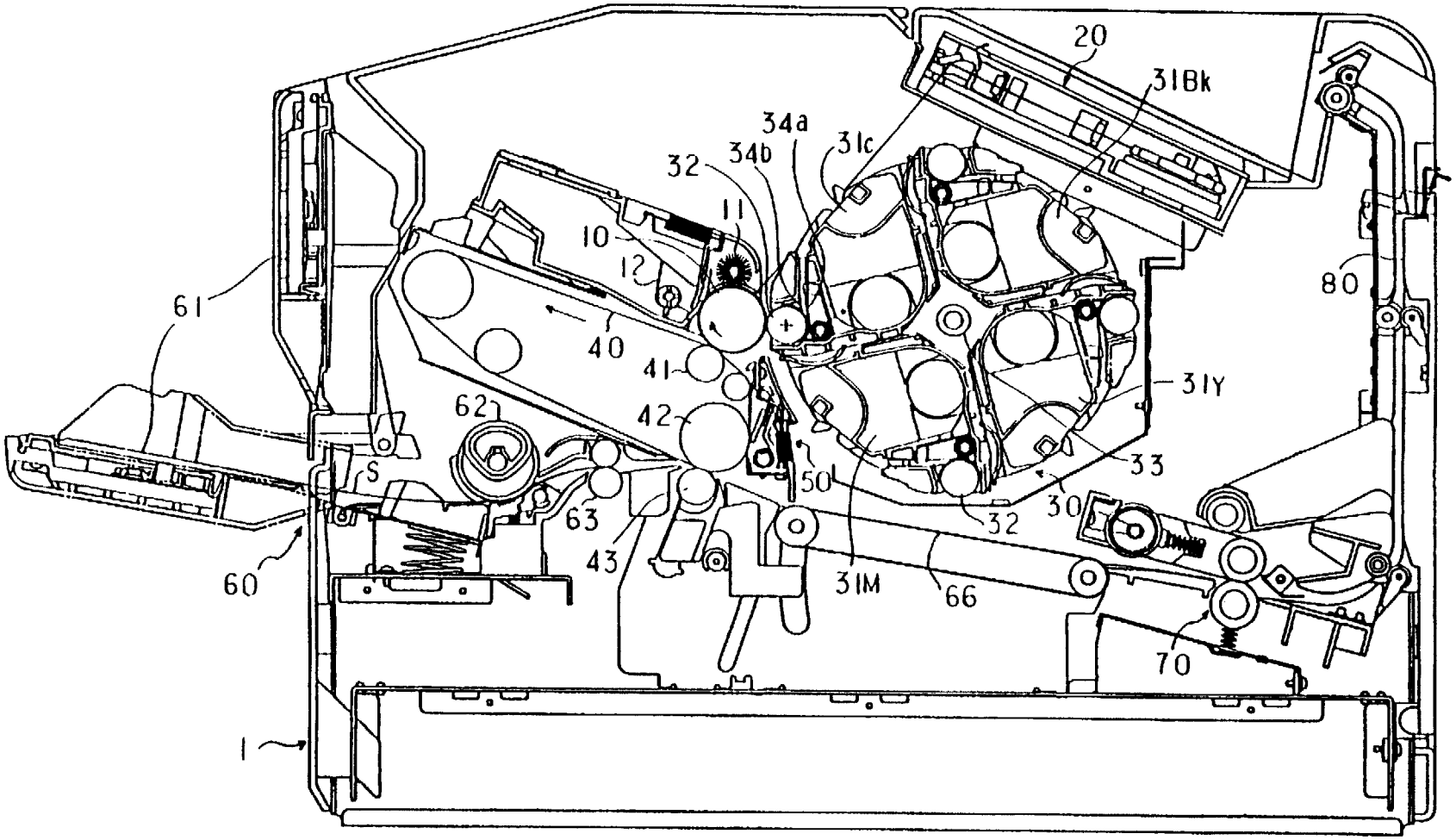
FIG. 1 is a schematic figure for illustrating an example of a full-color image forming apparatus for forming a full-color image by the use of a non-magnetic one-component toner for full-color development.

As described above, the toner for full-color development of the present invention comprises a binder resin which has a glass transition point Tg of from 60° to 75° C., a number-average molecular weight Mn of from 3500 to 6000, a ratio of a weight-average molecular weight Mw to the number-average molecular weight Mn (Mw/Mn, or a molecular weight distribution) ranging from 3 to 8, and a difference D T $(=T_1-T_2)$ between a temperature $T_1$ at the apparent melt viscosity of $1\times10^5$ poise and a temperature $T_2$ at the apparent melt viscosity of $1\times10^6$ poise in the range of from 8° to 15° C. A preferred binder resin is a polyester resin comprising an etherificated diphenol and an aromatic dicarboxylic acid, and having a grindability index of 11 to 28, and a softening point Tm of from 95° to 115° C., and a weight-average molecular weight Mw of from 15000 to 35000. More preferably, the aforesaid resin further contains polyolefin having a softening point Tm of 100° to 150° C.

The glass transition point Tg of the aforesaid binder resin was measured by the use of a differential scanning calorimeter (DSC-200 available from Seiko Electronics Co.Ltd.). 10 mg of a sample was accurately weighed and placed in an aluminum pan while alumina was placed in an aluminum pan for reference. After heating from a normal temperature to 200° C. at the heating rate of 300° C./min, the sample was cooled and then was heated at the heating rate of 10° C./min. for taking measurement in the range of from 20° to 120° C. In the heating process at this heating rate, the glass transition point Tg was established by finding a shoulder value at the main endothermic peak in the range of from 30° to 80° C.

The number-average molecular weight Mn and the weight-average molecular weight Mw of the binder resin was measured by the use of a gel permeation chromatography (807-IT available from Nihon Spectorum Industries Ltd.). 30 mg of a sample was continuously washed through with tetrahydrofuran acting as a carrier solvent at the rate of 1 kg/cm$^2$ in a column maintained at 40° C., thereby dissolving the sample in 20 ml of tetrahydrofuran. 0.5 mg of the resultant solution was introduced together with the aforesaid carrier solvent, thereby determining the molecular weight on the basis of polystyrene.

A temperature $T_1$ at the apparent melt viscosity of $1\times10^5$ poise, a temperature $T_2$ at the apparent melt viscosity of $1\times10^6$ poise and a softening point Tm of the binder resin was measured by the use of a flow tester (CFT-500 available from Shimadzu Corporation). 1.0 g of a sample was weighed and placed into a 1.0 mm×1.0 mm die. Using the aforesaid flow tester, the measurement was taken under conditions of the heating rate of 30° C./min, the preheating time of 180 sec, the load of 30 kg, and measurement temperature range of from 60° to 140° C. A softening point Tm was determined by a temperature at which a half of the sample flows out. There was obtained a temperature/apparent melt viscosity curve, from which were found a temperature $T_1$ at the melt viscosity of $1\times10^5$ poise and a temperature $T_2$ at the melt viscosity of $1\times10^6$ poise.

To find the grindability index, 30.0 g of a sample having a size of from 16 to 30 mesh was placed in a 2500 cc container of a Warling blender (available from Warling Inc.), which was rotated at 2200 rpm for 30 seconds. The resultant sample was sieved through a screen of 30 mesh and the residue (g) was measured. The grindability index was found by substituting the residue thus found in the following equation:

$$\text{Grindability index}=(\text{the residue}/30.0)\times100$$

A toner according to the present invention employs the binder resin having a glass transition point Tg of from 60° to 75° C. for the following reasons. If the binder resin has a glass transition point Tg of less than 60° C., the resultant toner has a poor heat resistance, causing aggregation during storage. Further, when the toner regulating member regulates the amount of toner on the developer sleeve serving as a toner bearing body, as mentioned above, the toner is apt to be set as agglomerate on the toner regulating member and the developer sleeve. Additionally, the resultant toner is reduced in stability against physical stress. On the other hand, if the binder resin has a glass transition point Tg of greater than 75° C., the resultant toner has a lower adhesion to the receiving material and exhibits an inferior color reproduction due to reduced color mixability, and hence, the production of an excellent full-color image cannot be assured. It is desirable to use a polyester resin having a glass transition point Tg of from 63° to 73° C.

The present invention employs the binder resin having a softening point Tm of from 95° to 115° C. for the following reasons. If the binder resin has a softening point of less than 95° C., high-temperature off-set is more likely to occur during the fixing process. Whereas if the binder resin has a softening point of greater than 115° C., the resultant toner exhibits a reduced fusibility and a lower paper adhesion index. In addition, the toner is reduced in transparency and color mixability, and thus, a resultant full-color image is reduced in gloss. It is preferred to use a polyester resin having a softening point of from 95° to 110° C.

The present invention employs the binder resin having a number-average molecular weight Mn of from 3500 to 6000 for the following reasons. If the number-average molecular weight Mn is smaller than 3500, the resultant toner has a decreased prevention of toner separation caused by paper folding. Accordingly, folding a copy sheet with a full-color image formed thereon would tend to cause toner separation at the corresponding portion of the image area, and hence, the copy will contain a blank portion in the image area. Whereas if the number-average molecular weight Mn is greater than 6000, the resultant toner exhibits lower thermal fusibility during the fixing process, resulting in a reduced paper adhesion index. Hence, it is desirable to use the resin having a number-average molecular weight Mn of from 4000 to 5500.

The present invention employs the binder resin having a weight-average molecular weight Mw of from 15000 to 35000 for the following reasons. If the weight-average molecular weight Mw is smaller than 15000, the resultant toner is apt to cause high temperature offset during the fixing process. If the weight-average molecular weight Mw is greater than 35000, the resultant toner exhibits a lower thermal fusibility during the fixing process, resulting in a reduced paper adhesion index. This also leads to a reduced transparency, color mixability, and prevention of toner separation caused by sheet folding and to an increased possibility of offsets. Hence, it is desirable to use the resin having a weight-average molecular weight of from 17000 to 30000.

For the following reasons, the present invention employs the binder resin having a molecular weight distribution (Mw/Mn) in the range of from 3.0 to 8.0. If the molecular weight distribution is smaller than 3.0, the resultant toner forms an image which is apt to cause high-temperature offsets. On the other hand, if the molecular weight distribution is greater than 8.0, the resultant toner exhibits a lower sharp-melting characteristic during the fixing process. This leads to a reduced transparency, color mixability, and color reproduction of an image thus formed, and hence the production of an excellent full-color copy cannot be assured. It is therefore desirable to use the resin with the molecular weight distribution (Mw/Mn) in the range of from 4.0 to 7.0.

For the following reasons, the present invention employs the binder resin having a difference ($DT=T_1-T_2$) between a temperature $T_1$ at the apparent melt viscosity of $1\times10^5$ poise and a temperature $T_2$ at the apparent melt viscosity of $1\times10^6$ poise in the range of from 8° to 15° C. If DT is less than 8° C., the resultant toner forms an image which is apt to cause high-temperature offsets. If DT is greater than 15° C., the resultant toner exhibits a reduced transparency, color mixability and color reproduction, and therefore the production of an excellent full-color copy cannot be assured. Hence, it is desirable to use the resin with DT of from 8° to 13° C.

The present invention employs the binder resin with a grindability index ranging from 11 to 28 for the following reasons. If the grindability index is smaller than 11, the resultant toner does not present a sufficient strength against physical stress. Accordingly, when the toner regulating member regulates the amount of toner on the toner bearing body, the toner tends to aggregate or to be set as agglomerate on the toner regulating member and the toner bearing member. If the grindability index exceeds 28, a resultant resin becomes so stiff, entailing reduction in the productivity of the toner fabrication by pulverization. Hence, it is desirable to use the resin with the grindability index of from 11 to 25.

For the following reasons, the present invention utilizes as the binder resin, the polyester resin comprising an etherificated diphenol as an alcohol component and an aromatic dicarboxylic acid as an acid component. Such a polyester resin provides a toner having an adequate sharp-melting characteristic, transparency and color mixability with the glass transition point Tg, molecular weight and fusibility in the aforesaid range. In addition, the resultant toner attains a sufficient strength with grindability index in the aforesaid range.

If the polyester resin has a softening point Tm in the aforesaid range of from 95° to 115° C., the resultant toner is increased in the adhesion index, adhering faster to copy paper. This also leads to decrease in the occurrence of toner separation caused by sheet folding or of offsets.

Specific examples of etherificated diphenols usable for the polyester resin include polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0) polyoxyethylene(2.0)-2,2-bis(4-hydroxyphenyl)propane, polyoxypropylene(6)-2,2-bis(4-hydroxyphenyl)propane, and the like.

For adjustment of the glass transition point or the softening point thereof, the polyester resin may further include a small amount of alcohol component besides the aforesaid etherificated diphenol. Specific examples of such alcohol component include diols such as ethylene glycol, diethylene glycol, triethylene glycol, 1,2-propylene glycol, 1,3-propylene glycol, 1,4-butanediol, neopentyl glycol and the like; and polyhydroxy alcohols such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methyl propanetriol, 2-methyl-1,2,4-butanetriol, trimethylolethane, trimethylolpropane, 1,3,5-trihydroxymethylbenzene and the like.

Examples of the aforesaid aromatic dicarboxylic acid include aromatic dicarboxylic acids such as terephthalic acid, isophthalic acid, and an anhydride or a lower alkyl esters thereof.

For adjustment of the glass transition point and the softening point thereof, the polyester resin may further include a small amount of aliphatic dicarboxylic acid besides the aforesaid aromatic dicarboxylic acid. Examples of such aliphatic dicarboxylic acid include fumaric acid, maleic acid, succinic acid, alkyl or alkenyl succinic acid having 4 to 18 carbon atoms, and an anhydride or a lower alkyl esters thereof.

For adjustment of the acid value or enhancement of the strength thereof, the polyester resin may further include, besides the above compounds, polyhydroxy carboxylic acid in such a small amount that may not affect the transparency of the resultant toner. Specific examples of such polyhydroxy corboxylic acid include 1,2,4-benzene tricarboxylic acid (trimellitic acid), 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxypropane, 1,2,4-cyclohexane-tricarboxylic acid, tetra (methylenecarboxyl)methane, 1,2,7,8-octane tetracarboxylic acid, pyromellitic acid, and an anhydride or a lower alkyl ester thereof.

Preferably used as the aforesaid polyester resin is a linear polyester resin obtained through reaction of monomer components, the aforesaid etherificated diphenol and the aromatic dicarboxylic acid, or a polyester resin comprised of etherificated diphenol, aromatic dicarboxylic acid and a small amount of the aforesaid polyhydroxy carboxylic acid. This is because such a polyhester resin includes as an acid component an aromatic dicarboxylic acid instead of an aliphatic dicarboxylic acid, whereby the resin presents a sufficient strength and a glass transition point Tg in the aforesaid range despite the molecular weight thereof set in a low range as mentioned above.

If the toner of the present invention includes the polyolefin having a softening point of from 100° to 150° C., the polyolefin is dispersed within the binder resin and the resultant toner is improved in stability against stress. This provides an inhibitory effect on white spots in an image area which is caused during image transfer under pressure. Furthermore, the toner is increased in the slipperiness so that the toner is less likely to be set as agglomerate on the toner regulating member and the developer sleeve while the toner regulating member as pressed against the developer sleeve is regulating and charging the toner.

For the following reasons, the present invention employs the aforesaid polyolefin having a softening point of from 100° to 150° C. If a polyolefin has a softening point of less than 100° C., the resultant toner cannot achieve an adequate stability against stress despite the polyolefin added thereto. Accordingly, it is difficult to prevent the toner from being set as agglomerate on the toner regulating member and the developer sleeve, or to avoid white spots in an image area which are caused during image transfer under pressure. On the other hand, if the softening point is greater than 150° C., the resultant toner is reduced in fusibility, exhibiting a lower paper adhesion index, transparency and color mixability.

Examples of the aforesaid polyolefin include polyethylene, oxygen convertible polyethylene, polypropylene, oxygen convertible polypropylene and the like. Specific examples of commercially available polyethylene include Sanwax 131P(softening point:108° C.), Sanwax 151P(softening point:107° C.), Sanwax 161P(softening point:111° C.), Sanwax 165P(softening point:107° C.) and Sanwax 171P(softening point:105° C.) which are fabricated by Sanyo Chemical Industries Ltd., and Hiwax 200P (softening point: 128° C.), Hiwax 310MP(softening point:122° C.) and Hiwax 400P(softening point:132° C.) which are fabricated by Mitsui Petrochemical Industries Co., Ltd. Examples of commercially available oxygen convertible polyethylene include Sanwax E300 (softening point:103.5° C., acid value:22) and Sanwax E250P (softening point:103.5° C., acid value:19.5) which are fabricated by Sanyo Chemical Industries Ltd, and Hiwax 4053E (softening point:111° C., acid value:25) fabricated by Mitsui Petrochemical Industries Co.,Ltd. Specific examples of polypropylene include Viscol 550P (softening point:150° C.) and Viscol 660P (softening point:145° C.) available from Sanyo Chemical Industries Ltd. Examples of oxygen convertible polypropylene include Viscol 200TS (softening point:145° C., acid value:3.5), Viscol 100TS (softening point:140° C., acid value:3.5) and Viscol 110TS (softening point:140° C., acid value:3.5) which are fabricated by Sanyo Chemical Industries Ltd. Preferred of these polyolefins is a polyolefin having an acid value of from 2 to 30 in the light of dispersibility with respect to a polyester resin used as the binder resin.

A preferable amount of polyolefin to be used in the binder resin is 0.5 to 5 parts by weight, more preferably 0.5 to 3 parts by weight per 100 parts by weight of the binder resin. If the content of polyolefin is less than 0.5 parts by weight, the resultant toner is not adequately improved in the stability against stress. Accordingly, it is difficult to prevent the toner from being set as agglomerate on the toner regulating member and the developer sleeve, or to avoid white spots in an image area which are caused during image transfer under pressure. Whereas if the content of polyolefin is greater than 5 parts by weight, the resultant toner has a reduced heat resistance during storage, transparency and color mixability. Additionally, such polyolefin is not uniformly dispersed in the binder resin, causing filming by adhering to the photoconductive drum and the developer sleeve.

In the toner of the present invention, a suitable colorant is added to the aforesaid binder resin to impart a suitable color to the toner. The followings exemplify a variety of usable colorants of magenta, cyan, yellow and black. However, it is to be appreciated that the usable colorants are not limited to these.

Examples of magenta colorants include magenta pigments such as C.I.Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 184, 202, 206, 207 and 209; and magenta dyes such as C.I. Solvent Red 1, 3, 8, 23, 24, 25, 27, 30, 49, 81, 82, 83, 84, 100, 109 and 121, C.I.Disperse Red 9, and C.I.Basic Red 1, 2, 9, 12, 13, 14, 15, 17, 18, 22, 23, 24, 27, 29, 32, 34, 35, 36, 37, 38, 39 and 40.

Examples of usable cyan colorant include cyan pigments such as C.I.Pigment Blue 2, 3, 15, 16 and 17.

Examples of usable yellow colorants include yellow pigments such as C.I.Pigment Yellow 1, 2, 3, 4, 5, 6, 7, 10, 11, 12, 13, 14, 15, 16, 17, 23, 65, 73 and 83, and C.I.Vat Yellow 1, 3, and 20; and yellow dyes such as C.I.Solvent Yellow 79 and 162.

Carbon Black may be used as a black colorant.

It is desirable that the aforesaid colorant is enhanced in dispersibility by means of a flushing process so as to be dispersed uniformly within the binder resin. Alternatively, the colorant is preferably processed by masterbatching for increased concentration thereof in which the colorant and the binder resin are blended by kneading and the resultant mixture is ground. If such colorants prepared by flushing or masterbatching are used as the colorant for the kneading/grinding method to be described as below, the colorant exhibits an increased dispersibility within the binder resin.

An amount of a colorant to be used is preferably from 2 to 15 parts by weight per 100 parts by weight of the binder resin. If a content of the colorant is in this range, the resultant toner has a sufficient light transmitting characteristic, and thus is optimized for development on an OHP film or the like.

Additionally to the above-mentioned binder resin and colorant, a toner according to the invention may further include a variety of additives such as a charge controlling agent and a post-treatment agent for adjustment of the chargeability and enhancement of the fluidity of the toner.

As to the charge controlling agent, it is desirable to use a colorless, white or pale-colored charge controlling agent so as not to reduce the color tone and the light transmitting characteristic of toners of different colors. For example, a metal chelate of salicylic acid comprised of a salicylic acid derivative and a metal such as zinc, calixarene compounds, boron compounds, or fluorine-containing quaternary ammonium salt compounds may be used alone or in combination.

The aforesaid metal chelate of salicylic acid is exemplified in U.S. Pat. Nos. 4,206,064 and 4,762,763; the calixarene compound is exemplified in U.S. Pat. No. 5,049,467; the boron compound in Japanese Unexamined Patent Publication No. 2-221967 (1990); and the fluorine-containing quaternary ammonium salt in U.S. Pat. No. 5,069,994. For adjustment of the carge quantity and improvement of the charging pull-up of the toner, a fluorine-containing quaternary ammonium salt compound may be used in combination with a charge controlling agent such as a metal chelate of salicylic acid or a calixarene compound.

It is preferable to add 0.1 to 10 parts by weight, or more preferably 0.5 to 5.0 parts by weight of the charge controlling agent to 100 parts by weight of the binding resin so as to impart the toner with an adequate chargeability and to bind the charge controlling agent to the binder resin.

Examples of the post-treatment agent include silica, alumina, titania, tin oxide, zirconium oxide and the like. These compounds may be used alone or in combination of two or more types. The use of a post-treatment agent subjected to hydrophobic treatment is preferred in the light of enhanced environmental stability. Examples of the agent for hydrophobic treatment includes coupling agents of various systems such as silane, titanate, aluminium and zircoaluminate, and silicon oils and the like. As to the aforesaid post-treatment agent, it is particularly preferable from the view point of toner fluidity and environmental stability related to the charging process that a hydrophobic silica and a hydrophobic titania, or a hydrophobic silica and a hydrophobic alumina are used in combination. An effective amount of the post-treatment agent to be used is from 0.2 to 3.0% by weight against the toner in the light of increased fluidity of the toner and of prevention of the adverse effect of a liberated post-treatment agent.

It is desirable to fabricate the toner of the invention by a kneading/pulverizing method which costs less and assures stable production thereof.

In the kneading/pulverizing method for fabricating the toner of the invention, the aforesaid binder resin, colorant and, if required, additives are blended in a mixing machine such as a Henshel mixer, and are melt-kneaded to obtain a mixture. The resultant mixture is cooled, roughly broken, and then finely pulverized. The particles thus obtained are classified to give desired toner particles. It is desirable to adjust the mean particle size of the toner particles within a range of from 5 to 10 μm for enhancement of the reproduction of a fine image.

An image forming apparatus according to the present invention should employ the foregoing toner for full-color development of the invention.

The present invention is applicable, for example, to the following types of image forming apparatus: an apparatus performing the image forming operations comprising the steps of irradiating light beams by means of writing means to form on a uniformly charged photoconductive drum an electrostatic latent image of a color corresponding to a specific color selected from the group consisting of magenta, cyan, yellow and black; developing the latent image into a toner image by supplying thereto a toner of a specific color selected from the group consisting of a magenta toner, a cyan toner, a yellow toner and a black toner; cyclically repeating the steps to transfer the toner images of the respective colors onto an intermediate transfer body; and transferring and fixing onto a receiving material the toner images thus superimposed on the intermediate transfer body: an apparatus performing the image forming operations comprising the steps of forming an electrostatic latent image of a specific color similarly to the aforesaid apparatus and developing the latent image with a toner of a specific color selected from the group consisting of a magenta toner, a cyan toner, a yellow toner and a black toner; transferring the toner image onto a receiving material held on an intermediate transfer body and cyclically repeating the above steps for the respective colors thereby superimposing the toner images; and fixing the toner images thus superimposed on the receiving material: or an apparatus performing the image forming operations comprising the steps of forming an electrostatic latent image on a photoconductive drum similarly to the foregoing apparatus and developing the latent image with a toner of a specific color selected from the group consisting of a magenta toner, a cyan toner, a yellow toner and a black toner; cyclically repeating the aforesaid steps for forming and developing the electrostatic latent images for the respective colors thereby superimposing the toner images on the photoconductive drum; and transferring and fixing onto a receiving material the toner image s thus superimposed. Of these image forming apparatus, the system adapted to transfer and superimpose the toner images of the respective colors onto the intermediate transfer body may be made smaller in size by the use of a transfer roller for transferring an image from the photoconductive drum to the intermediate transfer body and from the intermediate transfer body to the receiving material.

It is desirable to use a belt-type fixing unit as shown in FIG. 2 for fixing a toner image transferred onto copy paper as described above. More specifically, such a belt-type fixing unit allows preheating of the toner by a heat source provided at a tension roller and also provides a wider nip between a drive roller and a pressure roller, whereby a favorable fixing operation is assured.

In a fixing unit 70 as shown in FIG. 2, a fixing belt 73 is trained about a tension roller 71 with a halogen lamp 72 contained therein as the heat source and a drive roller 74 rotatably driven. The fixing belt 73 is caused to run by the rotation of the drive roller 74, while being heated by the halogen lamp 72. A pressure roller 75 opposes the drive roller 74 for clamping the fixing belt 73 in cooperation therewith. Disposed at the upper front side of the fixing belt 73 is an oil applying roller 76 such as composed of a felt member for applying a toner-cleaning oil. The oil applying roller 76 is driven to rotate by the motion of the fixing belt 73.

When a copy sheet S with a toner image transferred thereon as mentioned above is introduced into the fixing unit 70, the copy sheet S is heated by the aforesaid hot, running fixing belt 73 as spaced therefrom. At this point, the toner on the sheet is softened to some degree, while the copy sheet S in this state is introduced into the nip portion defined between the drive roller 74 and pressure roller 75 opposing each other. At the nip portion, the copy sheet S with the toner image transferred thereon is heated and pressed between the fixing belt 73 and the pressure roller 75 so as to adequately soften the toner which has been somewhat softened, and thus the toner image is fixed onto the copy sheet S. In the fixing unit 70, the drive roller 73 has a higher hardness than the pressure roller 75 such that the drive roller 73 protrudes into the pressure roller 75 in a convex form in section at the nip portion, thus pressing the toner image.

After fixing the toner image to the copy sheet S, the fixing belt 73 driven by the drive roller 74 is applied with the toner-cleaning oil by the oil applying roller 76 for cleaning of toner adhering thereto.

Although the fixing unit 70 includes the halogen lamp 72 as the heat source within the tension roller 71, the arrangement should not be limited to the above. For example, the heat source may be of the electromagnetic induction heating system as disclosed in Japanese Unexamined Patent Publication No. 6-276685 (1994), or the heat source may also be provided in the drive roller 74 additionally to the tension roller 71.

Now, the toner for full-color development of the invention will be described in detail by way of specific examples thereof and comparative examples.

In the examples and comparative examples, polyester resins A through J were prepared in the following manner and were used as the binder resin.

[Polyester Resins A and B]

In preparation of Polyester Resin A or B, polyoxypropylene(2,2)-2,2-bis(4-hydorxyphenyl)propane (hereinafter referred to as PO), polyoxyethylene(2.0)-2,2-bis(4-hydroxyphenyl)propane (hereinafter referred to as EO), and terephthalic acid (hereinafter referred to as TPA) were blended together to obtain a mixture in the molar ratio of 3:7:9. The resultant mixture was put into a 2-litter four-neck flask. A reflux condenser, a water separator, a nitrogen gas introduction tube, a thermometer and a stirrer were mounted in the flask. With nitrogen gas introduced through the nitrogen gas introduction tube, the mixture in the flask was heated as stirred to be brought into reaction.

During the reaction, the reaction state was traced by measurement of the acid value. When the acid value reached a predetermined point, the reaction was terminated thereby obtaining Polyester Resin A or B.

[Polyester Resin C]

Polyester Resin C was prepared by the same reaction as Polyester Resins A and B except that PO, EO and TPA were blended together to obtain a mixture in the molar ratio of 5:5:9.

[Polyester Resin D]

Polyester Resin D was prepared by the same reaction as Polyester Resins A and B except that PO, EO, TPA and trimellitic acid were blended together to obtain a mixture in the molar ratio of 7:3:8:1.

[Polyester Resin E]

Polyester Resin E was prepared by the same reaction as Polyester Resins A and B except that PO, EO, fumaric acid and TPA were blended together to obtain a mixture in the molar ratio of 5:5:5:4.

[Polyester Resin F]

Polyester Resin F was prepared by the same reaction as Polyester Resins A and B except that PO, EO and TPA were blended together to obtain a mixture in the molar ratio of 9:1:9.

[Polyester Resin G]

Polyester Resin G was prepared by the same reaction as Polyester Resins A and B except that PO, EO, succinic acid, TPA and trimellitic acid were blended together to obtain a mixture in the molar ratio of 7:3:1:6:2.

[Polyester Resin H]

Polyester Resin H was prepared by the same reaction as Polyester Resins A and B except that PO, EO, fumaric acid and TPA were blended together to obtain a mixture in the molar ratio of 3:7:5:4.

[Polyester Resin I]

Polyester Resin I was prepared by the same reaction as Polyester Resins A and B except that PO, EO, TPA and trimellitic acid were blended together to obtain a mixture in the molar ratio of 7:3:7:2.

[Polyester Resin J]

Polyester Resin J was prepared by the same reaction as Polyester Resins A and B except that PO, EO, succinic acid, TPA and trimellitic acid were blended together to obtain a mixture in the molar ratio of 7:3:3:5:1.

As to aforesaid Polyester Resins A through J, the number-average molecular weight Mn, the weight-average molecular weight Mw, the molecular weight dispersion (Mw/Mn), the glass transition point Tg, the temperature $T_1$ at the apparent melt viscosity of $1\times10^5$ poise, the temperature $T_2$ at the apparent melt viscosity of $1\times10^6$ poise, and the difference $DT(=T_1-T_2)$ between $T_1$ and $T_2$ were found respectively in the aforementioned manner. The grindability index of Polyester Resins A through H and the softening point Tm of Polyester Resins A through E, I and J were found. The results are given in the following Table 1.

TABLE 1

| Resin | Mn | Mw | Mw/Mn | Tg °C. | $T_1$ °C. | $T_2$ °C. | DT °C. | Tm °C. | G. Index |
|---|---|---|---|---|---|---|---|---|---|
| A | 5000 | 20000 | 4 | 65 | 110 | 99 | 11 | 105 | 18 |
| B | 3800 | 15200 | 4 | 62 | 102 | 93 | 9 | 97 | 11 |
| C | 4500 | 20250 | 4.5 | 73 | 117 | 104 | 13 | 112 | 25 |
| D | 3600 | 28800 | 8 | 68 | 120 | 106 | 14 | 115 | 13 |
| E | 3700 | 10360 | 2.8 | 56 | 93 | 86 | 7 | 88 | 7 |
| F | 5500 | 27500 | 5 | 77 | 122 | 105 | 17 | | 30 |
| G | 2800 | 30800 | 11 | 70 | 117 | 100 | 17 | | 8 |
| H | 4800 | 24000 | 5 | 64 | 100 | 87 | 13 | | 35 |
| I | 3500 | 42000 | 12 | 68 | 124 | 101 | 23 | 117 | |
| J | 5200 | 52000 | 10 | 62 | 125 | 108 | 17 | 120 | |

EXAMPLE 1

In Example 1, Polyester Resin A and a cyan colorant (C.I.Pigment Blue 15-3 available from Toyo Ink Mfg.Co., Ltd.) in the ratio of 7:3 were loaded in a pressure kneader for kneading. The resultant mixture was broken by a feather mill thereby to obtain a pigment masterbatch. 10 parts by weight of the pigment masterbatch, 93 parts by weight of Polyester Resin A and 2 parts by weight of a charge controlling agent comprising salicylic acid zinc complex (E—84 available from Orient Chemical Industries) were mixed in a Henchell mixer, and the resultant mixture was kneaded by means of a two axial extruder. After cooling, the resultant mixture was roughly broken by a feather mill, finely pulverized by a jet mill and classified to give toner particles having the mean particle size of 8.0 μm.

Then 0.8% by weight of hydrophobic silica (H1303 available from HDK Co.,Ltd.) and 1.0% by weight of hydrophobic titania A having the hydrophobicity of 60% were added to the particles and mixed for treatment in a Henschell mixer to give the toner of Example 1. The hydrophobic titania A was prepared in the following manner. Titania (STT30 available from Chitan Industries) having the mean primary particle size of 50 nm was mixed with water by stirring, and then 20% by weight in solid content of n-hexyl trimethoxysilane was added thereto. The resultant mixture was dried and crushed to give hydrophobic titania A having the hydrophobicity of 60%. To measure the hydrophobicity, 50 ml of pure water was put into a 200 ml beaker and 0.2 g of a sample was mixed therewith by stirring. Through a buret, methanol dehydrated with sodium sulfate anhydride was added to the resultant mixture while the mixture was continued to be stirred to reach an end point that the sample could hardly be observed on the liquid surface. A used amount of methanol was substituted in the following equation, thereby finding the hydrophobicity.

$$\text{Hydrophobicity} = \frac{\text{Amount of methanol}}{50 + \text{amount of methanol}} \times 100$$

EXAMPLE 2

A toner of Example 2 was prepared in the same manner as in Example 1 except that Polyester Resin A used in Example 1 was replaced with Polyester Resin B and that the cyan colorant was replaced with a magenta colorant (C.I.Pigment Red 184 available from Dainippon Ink & Chemicals, Inc.).

EXAMPLE 3

In Example 3, toner particles were prepared in the same manner as in Example 1 except that Polyester Resin A was replaced with Polyester Resin C. Thereafter, 0.8% by weight of hydrophobic silica (H1303 available from HDK Co.,Ltd.) and 1.0% by weight of hydrophobic titania B having the hydrophobicity of 60% were added to the toner particles and treated, thereby to give the toner of Example 3. The titania B was prepared in the following manner.

In preparation of the hydrophobic titania B, 5 parts by weight of dimethyl polysiloxane having the viscosity of 500 centistokes at 25° C. was diluted with 50 parts by weight of xylene to obtain a solution. The resultant solution was spray-dried on 100 parts by weight of titania having the mean primary particle size of 15 nm (MT150A available from Teika Co.,Ltd.). The resultant titania was heated and crushed to give titania B having the hydrophobicity of 60%. The hydrophobicity of titania B was determined in the same manner as the aforesaid titania A.

EXAMPLE 4

A toner of Example 4 was prepared in the same manner as in Example 1 except that Polyester Resin A used in Example 1 was replaced with Polyester Resin D.

Comparative Example 1

A toner of Comparative Example 1 was prepared in the same manner as in Example 3 except that Polyester Resin C used in Example 3 was replaced with Polyester Resin E.

Comparative Example 2

A toner of Comparative Example 2 was prepared in the same manner as in Example 3 except that Polyester Resin C used in Example 3 was replaced with Polyester Resin F.

Comparative Example 3

A toner of Comparative Example 3 was prepared in the same manner as in Example 3 except that Polyester Resin C used in Example 3 was replaced with Polyester Resin G.

Comparative Example 4

A toner of Comparative Example 4 was prepared in the same manner as in Example 3 except that Polyester Resin C used in Example 3 was replaced with Polyester Resin H.

Comparative Example 5

A toner of Comparative Example 5 was prepared in the same manner as in Example 3 except that Polyester Resin C used in Example 3 was replaced with Polyester Resin I.

Comparative Example 6

A toner of Comparative Example 6 was prepared in the same manner as in Example 3 except that Polyester Resin C used in Example 3 was replaced with Polyester Resin J.

Now with reference to FIGS. 1 and 2, an example of a full-color image forming apparatus for forming a full-color image by the use of the aforesaid toners will be described more specifically.

In the full-color image forming apparatus shown in FIG. 1, disposed around a rotatably driven photoconductive drum 10 are a charging brush 11 for uniformly charging the surface of the photoconductive drum 10 to a predetermined potential and a cleaner 12 for cleaning the surface of the photoconductive drum 10 of remaining toner.

The image forming apparatus includes a laser scan optical system 20 which uses laser beams to scan and expose the photoconductive drum 10 charged by the charging brush 11. The laser scan optical system 20 is of a known type incorporating a laser diode, polygon mirror and fθ optical device. Its control unit receives from a host computer individual printing data of cyan, magenta, yellow and black. The laser scan optical system 20 is adapted to sequentially output laser beams based on the individual printing data for scanning and exposing the surface of the photoconductive drum 10 thereby sequentially forming thereon electrostatic latent images of individual colors.

A full-color developing system 30 effects full-color development by supplying toners of individual colors to the photoconductive drum 10 having the electrostatic latent images formed thereon. The full-color developing system 30 includes four developing units of individual colors 31C, 31M, 31Y and 31B around a support shaft 33, which developing units contain non-magnetic one-component toners of cyan, magenta, yellow and black respectively. The developing units 31C, 31M, 31Y and 31B rotate about the support shaft 33 to be located at a position opposite to the photoconductive drum 10.

In the full-color developing system 30, as shown in FIG. 3, each developing unit 31C, 31M, 31Y and 31B includes two toner regulating members **34*a*, 34*b* pressed against the outer peripheral surface of a developer sleeve 32 for transporting a toner as rotating. The two toner regulating members 34*a*, 34*b* operate to regulate an amount of a toner to be transported by the developer sleeve 32 while charging the toner being transported. In this full-color developing system 30, the two toner regulating members 34*a*, 34*b* are provided for appropriate regulation and charging of a toner transported by the developer sleeve 32**, but it is apparent to the skilled in the art that one toner regulating member may be provided.

Each time the laser scan optical system 20 forms on the photoconductive drum 10 an electrostatic latent image of each color, as described above, the full-color developing system 30 is caused to rotate about the support shaft 33 thereby sequentially locating a developing unit 31C, 31M, 31Y or 31B of a corresponding color at the position opposite to the photoconductive drum 10. Then, the developer sleeves 32 of the developing units 31C, 31M, 31Y and 31B are sequentially brought into contact with the photoconductive drum 10 to supply charged toners of corresponding colors to the electrostatic latent images of the respective colors sequentially formed thereon, thereby developing toner images of the respective colors.

An intermediate transfer belt 40 as an intermediate transfer body 40 is disposed downstream of the full-color developing system 30 in the rotational direction of the photoconductive drum 10. The intermediate transfer belt 40 is an endless belt which is rotatably driven in synchronism with the photoconductive drum 10. The intermediate transfer belt 40 is brought into contact against the photoconductive drum 10 by a rotatable primary transfer roller 41. A secondary transfer roller 43 is rotatably provided at a support roller 42 for supporting the intermediate transfer belt 40. The secondary transfer roller 43 operates to press the receiving material S such as copy paper against the intermediate transfer belt 40.

In a space between the full-color developing system 30 and the intermediate transfer belt 40, a cleaner 50 for cleaning the intermediate transfer belt 40 of remaining toner is present in releasable contact therewith.

Paper feed means 60 for introducing the receiving material S such as copy paper comprises a paper feed tray 61 accommodating copy paper S, a paper feed roller 62 for taking up one copy sheet S at a time from the paper feed tray 61, and a timing roller 63 for forwarding a copy sheet S to a position between the intermediate transfer belt 40 and the secondary transfer roller 43, which copy sheet S is fed in synchronism with forming of an image on the intermediate transfer belt 40. Thus, the copy sheet S passing between the intermediate transfer belt 40 and the secondary transfer roller 43 is pressed against the intermediate transfer belt 40 by the secondary transfer roller 43 so that a toner image is transferred by pressure from the intermediate transfer belt 40 onto the copy sheet S.

The copy sheet S with the toner image transferred thereon by pressure is carried to a fixing unit 70 by transport means 66 such as comprised of an air-suction belt. The fixing unit 70 fixes the toner image onto the copy sheet S in the aforesaid manner. Thereafter, the copy sheet S is discharged through a vertical transport passage 80 to the upper surface of the main body 1 of the apparatus.

Next, specific operations of the full-color image forming apparatus for forming a full-color image will be described.

The photoconductive drum 10 and the intermediate transfer belt 40 are caused to rotate in the respective directions at the same peripheral velocity, while the photoconductive drum 10 is charged by the charging brush 11 to a predetermined potential.

Subsequently, the photoconductive drum 10 thus charged is exposed to a cyan image by the aforesaid laser scan optical system 20 thereby forming an electrostatic latent image of cyan thereon. The photoconductive drum 10 is supplied with a cyan toner by the developing unit 31C, which cyan toner is charged by the toner regulating members **34*a*, 34*b* as described above, and thus, a cyan image is developed. The primary transfer roller 41 presses the intermediate transfer belt 40 against the photoconductive drum 10 with the toner image of cyan formed thereon thereby effecting the primary transfer of the toner image of cyan from the photoconductive drum 10 to the intermediate transfer belt 40**.

After the toner image of cyan is transferred onto the intermediate transfer belt 40, the full-color developing system 30 is caused to rotate about the support shaft 33 to locate the developing unit 31M containing a magenta toner at the position opposite to the photoconductive drum 10. Similarly to the case of the cyan image, the charged photoconductive drum 10 is exposed to a magenta image by the laser scan optical system 20 thereby forming thereon an electrostatic latent image of magenta. The resultant electrostatic latent image is developed by the developing unit 31M containing the magenta toner. Then the primary transfer of the toner image of magenta thus developed is effected to the intermediate transfer belt 40. In like manner, exposure, development and primary transfer of a yellow image and a black image are cyclically repeated so as to superimpose toner images of cyan, magenta, yellow and black sequentially, and thus a full-colored toner image is formed on the intermediate transfer belt 40.

In response to the primary transfer of the last toner image of black onto the intermediate transfer belt 40, the timing roller 63 forwards a copy sheet S to a position between the secondary transfer belt 43 and the intermediate transfer belt 40. The secondary transfer roller 43 presses the copy sheet S against the intermediate belt 40 thereby effecting the secondary transfer of the full-colored toner image from the intermediate transfer belt 40 to the copy sheet S.

When the secondary transfer of the full-colored toner image is effected to the copy sheet S, the copy sheet S is carried by the transport means 66 to the fixing unit 70, which fixes onto the copy sheet S the full-colored toner image thus transferred. Thereafter, the copy sheet S is discharged through the vertical transport passage 80 to the upper surface of the main body 1 of the apparatus.

The toners of Examples 1 through 4 and Comparative Examples 1 through 4 were examined on the heat resistance during storage and the grindability. The toners of Examples 1 through 4 and Comparative Examples 1 through 6 were loaded in developing units of corresponding colors in the full-color image forming apparatus shown in FIG. 1 so as to examine the aggregation/agglomeration characteristics, the prevention of separation caused by sheet folding, the adhesion index and the transparency thereof. The toners of Examples 1 through 4 and Comparative Examples 1, 5 and 6 were examined on the offset preventing characteristic. The toners of Examples 1 through 4 and Comparative Examples 1 and 2 were examined on the occurrence of white spots in the image area. The results are given in Table 2.

As to the heat resistance during storage, 5 g of the above toners were each put into a glass bottle and were allowed to stand at 60° C. for 5 hours. A toner which caused aggregation was given C (unacceptable), a toner which was practically acceptable slightly causing aggregation was given B (acceptable) and a toner which was free from aggregation was given A (excellent).

As to the grindability, the grindability index of the respective toners was found by the use of a Warling blender in a similar manner to the aforesaid polyester resins. A toner exhibiting a grindability index of less than 20 was given A, a toner exhibiting an index of not less than 20 and not greater than 23 was given B, and a toner exhibiting an index of greater than 23 was given C.

As to the aggregation/agglomeration, evaluation was made shortly after the aforesaid full-color image forming apparatus performed the image forming operations. A toner which caused no aggregation or agglomeration on the toner regulating member or toner bearing body was given A, a toner which was practically acceptable slightly causing aggregation/agglomeration was given B, and a toner which was practically unacceptable being set as agglomerate was given C.

As to the prevention of separation caused by sheet folding, a solid image was formed on a copy sheet by means of the aforesaid full-color image forming apparatus, and then the copy sheet was folded in half. A toner causing separation in the image area was given C, a toner causing a thin crack in the image area was given B, and a toner causing no separation nor crack in the image area was given A.

As to the adhesion index, a solid image having the image density ID of 1.2 was formed by means of the aforesaid full-color image forming apparatus. The image density was measured by the use of a complementary color filter. The resultant image was subject to a test wherein an eraser applied with a load of 1 kg was rubbed back and forth against the image area three times. Then the image density ID of each image was measured by means of the complementary color filter. A toner retaining 85% or more of the image density before the test was given A, a toner retaining 70 to 85% of the image density before the test was given B, and a toner retaining less than 70% of the image density before the test was given C.

As to the transparency, a solid image was formed on an OHP film by means of the aforesaid full-color image forming apparatus. The resultant image was projected by an overhead projector and the color definition of the projected image was visually evaluated. A toner exhibiting a good color reproduction was given A, a toner which was practically acceptable was given B, and a toner exhibiting an inferior chroma was given C.

As to the offset preventing characteristic, an image was fixed at 165° C. and the state of offset was visually evaluated. A toner which caused no offset was given A, a toner which caused a slight offset was given B, and a toner which caused a marked offset was given C.

As to the white spots, the evaluation was made shortly after the aforesaid full-color image forming apparatus performed the image forming operations. A toner causing no white spots in the image area was given A, a toner which was practically acceptable causing some white spots in the image area was given B, and a toner which was practically unacceptable causing many white spots in the image area was given C.

TABLE 2

| | Examples | | | | C. Examples | | | | | |
|---|---|---|---|---|---|---|---|---|---|---|
| | 1 | 2 | 3 | 4 | 1 | 2 | 3 | 4 | 5 | 6 |
| Heat resistance during storage | A | B | A | A | C | A | A | A | | |
| Grindability | A | A | B | A | A | C | A | C | | |
| Aggregation/ agglomeration | A | B | A | A | C | A | C | A | A | A |
| Prevention of Separation due to folding | A | A | A | A | C | A | C | A | A | A |
| Adhesion index | A | A | B | B | A | C | C | A | C | C |
| Transparency | A | A | B | B | A | C | B | A | C | C |
| Offset prevention | A | B | A | A | C | | | | A | A |
| White spots | A | B | B | A | C | B | | | | |

As apparent from Table 2, because the toners of Examples 1 through 4 comprise as the binder resin, polyester resins satisfying the aforesaid conditions of the present invention, the toners do not suffer a lower productivity during the fabrication thereof by pulverizing. Additionally, such toners exhibit excellent heat resistance during storage, adhesion index, transparency and color mixability. Furthermore, because of the sufficient mechanical strength thereof, the toners are less liable to be set as agglomerate on the toner regulating member and the toner bearing body when the toners on the surface of the toner bearing body are regulated in the amount and charged by the toner regulating member. The toners cause less offsets. Because of the excellent transferring performance thereof, the toners reduce the occurrence of white spots in the image area when an image is transferred by pressure onto the intermediate transfer body or the receiving material.

It is concluded that the use of toners of Examples 1 through 4 satisfying the conditions of the present invention assures production of a full-color image excellent in transparency and color mixability.

EXAMPLE 5

In Example 5, aforesaid Polyester Resin A and a cyan colorant (C.I.Pigment Blue 15-3 available from Toyo Ink Mfg.Co.,Ltd.) in the ratio of 7:3 were loaded in a pressure kneader for kneading. The resultant mixture was broken by a feather mill thereby to obtain a pigment masterbatch.

10 parts by weight of the pigment masterbatch, 93 parts by weight of Polyester Resin A, 2 parts by weight of a charge controlling agent comprising salicylic acid zinc complex (E-84 available from Orient Chemical Industries), and 2 parts by weight of polypropylene having the softening point of 140° C. and the acid value of 3.5 (Viscol available from Sanyo Chemical Industries Ltd.) were mixed in a Henchell mixer, and the resultant mixture was kneaded by means of a two axial extruder.

After cooling, the resultant mixture was roughly broken by a feather mill, finely pulverized by a jet mill and classified to give toner particles having the mean particle size of 8.0 μm.

Then 0.8% by weight of hydrophobic silica (H1303 available from HDK Co.,Ltd.) and 1.0% by weight of the aforesaid hydrophobic titania A having the hydrophobicity of 60% were added to the particles and were treated by mixing in a Henschell mixer to give the toner of Example 5.

EXAMPLE 6

A toner of Example 6 was prepared in the same manner as in Example 5 except that Polyester Resin A used in Example 5 was replaced with Polyester Resin B and that the aforesaid polypropylene was replaced with polyethylene having the softening point of 103.5° C. and the acid value of 19.5 (Sanwax E250P available from Sanyo Chemical Industries Ltd.).

EXAMPLE 7

In Example 7, toner particles were prepared in the same manner as in Example 5 except that Polyester Resin A used in Example 5 was replaced with Polyester Resin C and that the aforesaid polypropylene was replaced with polyethylene having the softening point of 128° C. (Hiwax 200 available from Mitsui Petrochemial Industries Co.,Ltd.). Then 0.8% by weight of hydrophobic silica (H1303 available from HDK Co.,Ltd.) and 1.0% by weight of the aforesaid hydrophobic titania B having the hydrophobicity of 60% were added to the particles and were treated by mixing to give the toner of Example 7.

EXAMPLE 8

A toner of Example 8 was prepared in the same manner as in Example 5 except that Polyester Resin A used in Example 5 was replaced with Polyester Resin D and that the aforesaid polypropylene was replaced with polypropylene having the softening point of 145° C. (Viscol 660P available from Sanyo Chemical Industries Ltd.)

Comparative Example 7

A toner of Comparative Example 7 was prepared in the same manner as in Example 7 except that the polyethylene used in Example 7 was replaced with Sazolwax A1 having the softening point of 90° C. which is available from Katohyoko Co.,Ltd.

Comparative Example 8

A toner of Comparative Example 8 was prepared in the same manner as in Example 7 except that the polyethylene used in Example 7 was replaced with Hiwax NP805 having the softening point of 156° C. which is available from Mitsui Petrochemical Industries Co.,Ltd.

Comparative Example 9

A toner of Comparative Example 9 was prepared in the same manner as in Example 7 except that the polyethylene used in Example 7 was not used.

Comparative Example 10

A toner of Comparative Example 10 was prepared in the same manner as in Example 7 except that Polyester Resin C used in Example 7 was replaced with Polyester Resin E.

Comparative Example 11

A toner of Comparative Example 11 was prepared in the same manner as in Example 7 except that Polyester Resin C used in Example 7 was replaced with Polyester Resin F.

The toners of Examples 5 through 8 and Comparative Examples 7 through 11 were examined on the heat resistance during storage. The above toners were each loaded in a developing unit of a corresponding color of the full-color image forming apparatus so as to form an image. Similarly to the foregoing, the respective toners were examined on the aggregation/agglomeration, transparency, adhesion index and occurrence of white spots. The results are given in Table 3.

As to the aggregation/agglomeration, evaluation was made shortly after the aforesaid full-color image forming apparatus performed the image forming operations and after 3000 copies were produced. A toner which caused no aggregation nor agglomeration on the toner regulating member and the toner bearing body was given A, a toner which was practically acceptable slightly causing aggregation or agglomerate was given B, and a toner which was practically unacceptable being set as agglomerate was given C.

As to the white spots, the evaluation was made shortly after the aforesaid full-color image forming apparatus performed the image forming operations and after 3000 copies were produced. A toner causing no white spots in the image area was given A, a toner which was practically acceptable causing some white spots in the image area was given B, and a toner which was practically unacceptable causing many white spots in the image area was given C.

TABLE 3

| | A/A | | | | | W.S. | |
|---|---|---|---|---|---|---|---|
| | H.R.S. | S.V.C. | 3000C | T | A.I. | S.V.C.. | 3000C |
| Ex. 5 | A | A | A | A | A | A | A |
| Ex. 6 | B | B | B | A | A | B | B |
| Ex. 7 | A | A | B | B | B | B | B |
| Ex. 8 | A | A | A | B | B | A | A |
| C. Ex. 7 | B | A | C | B | B | B | C |
| C. Ex. 8 | A | A | B | C | C | B | B |
| C. Ex. 9 | A | A | C | B | B | B | C |
| C. Ex. 10 | C | C | C | B | A | C | C |
| C. Ex. 11 | A | A | A | C | C | B | B |

Note: In the table, H.R.S. represents "heat resistance during storage"; A/A "aggregation/agglomeration"; T "transparency"; A.I. "adhesion index"; W.S. "white spots"; S.V.C. "small volume copies"; and 3000C "3000 copies".

As apparent from Table 3, because the toners of Examples 5 through 8 comprise as the binder resin polyester resins satisfying the aforesaid conditions of the invention and further include polyolefin having the softening point of from 100° to 150° C., the toners have excellent heat resistance during storage, adhesion index, transparency and color mixability. Additionally, the toners are less liable to be set as agglomerate on the toner regulating member and the toner bearing body when the toners on the toner bearing body are regulated in the amount and charged by the toner regulating member. Because of the good transferring characteristic thereof, the toners are effective over a long time period to reduce white spots in the image area which are caused during transfer of an image onto the intermediate transfer body or the receiving material.

It is concluded that the use of the toners of Examples 5 through 8 satisfying the conditions of the invention assures production of full-color images excellent in transparency and color mixability.

What is claimed is:

1. A toner for full-color development comprising:

a colorant, and a binder resin having a glass transition point Tg of from 60° to 75° C., a number-average molecular weight Mn of from 3500 to 6000, a ratio of a weight-average molecular weight Mw to the number-average molecular weight Mn (Mw/Mn) ranging from 3 to 8, and a difference between a temperature $T_1$ at the apparent melt viscosity of $1\times10^5$ poise and a temperature $T_2$ at the apparent melt viscosity of $1\times10^6$ poise, $DT(=T_1-T_2)$ in the range of from 8° to 15° C.

2. The toner for full-color development as claimed in claim 1, wherein said binder resin has a glass transition point Tg of from 63° to 73° C., a number-average molecular weight Mn of from 4000 to 5500, a ratio of a weight-average molecular weight Mw to the number-average molecular weight Mn (Mw/Mn) ranging from 4 to 7, and a difference $DT(=T_1-T_2)$ in the range of from 8° to 13° C.

3. The toner for full-color development as claimed in claim 1, wherein said binder resin is a polyester resin comprising an alcohol component composed of an etherificated diphenol and an acid component composed of an aromatic dicarboxylic acid.

4. The toner for full-color development as claimed in claim 3, wherein the etherificated diphenol comprises a polyoxyethylene bisphenol A and a polyoxypropylene bisphenol A.

5. The toner for full-color development as claimed in claim 1, wherein said binder resin has a grindability index of from 11 to 28.

6. The toner for full-color development as claimed in claim 1, wherein said colorant is treated by masterbatch or flushing process.

7. The toner for full-color development as claimed in claim 1 further comprising a charge controlling agent selected from the group consisting of salicylic acid metal acid compounds, calixarene compounds, organic boron salt complex compounds and fluorine-containing quaternary ammonium salt compounds.

8. The toner for full-color development as claimed in claim 7, wherein said charge controlling agent is added in 0.1 to 10 parts by weight per 100 parts by weight of the binder resin.

9. The toner for full-color development as claimed in claim 1 further comprising a post-treatment agent selected from the group consisting of hydrophobic silica, hydrophobic alumina and hydrophobic titania.

10. The toner for full-color development as claimed in claim 9, wherein said post-treatment agent is added in 0.2 to 3 parts by weight against the toner.

11. The toner for full-color development as claimed in claim 1, wherein said binder resin has a softening point of from 95° to 115° C. and a weight-average molecular weight of from 15000 to 35000.

12. The toner for full-color development as claimed in claim 1 further comprising polyolefin wax.

13. The toner for full-color development as claimed in claim 12, wherein said polyolefin wax has a softening point of from 100° to 150° C.

14. The toner for full-color development as claimed in claim 12, wherein said polyolefin wax is an oxygen convertible polyolefin having an acid value of from 2 to 30.

15. The toner for full-color development as claimed in claim 12, wherein said polyolefin wax is added in 0.5 to 5.0 parts by weight per 100 parts by weight of the binder resin.

16. The toner for full-color development as claimed in claim 1 comprising a colored toner.

17. An image forming apparatus comprising:

an image bearing body, and a developing system including a developer and developing a latent image on the image bearing body into a toner image, which developer is of a one-component type comprising a non-magnetic toner comprised of a colorant and a binder resin which has a glass transition point Tg of from 60° to 75° C., a number-average molecular weight Mn of from 3500 to 6000, a ratio of a weight-average molecular weight Mw to the number-average molecular weight Mn (Mw/Mn) ranging from 3 to 8, and a difference between a temperature $T_1$ at the apparent melt viscosity of $1\times10^5$ poise and a temperature $T_2$ at the apparent melt viscosity of $1\times10^6$ poise, $DT(=T_1-T_2)$ in the range of from 8° to 15° C.

18. The image forming apparatus as claimed in claim 17, wherein said developing system comprises a developer bearing body holding the developer on the peripheral surface thereof for supplying the image bearing body with the developer, and a developer regulating member for regulating the developer on the developer bearing body while charging the same.

19. The image forming apparatus as claimed in claim 17 further including a transfer system for transferring a toner image on the image bearing body to a receiving medium.

20. The image forming apparatus as claimed in claim 19, wherein said transfer system comprises a toner image retaining member, a primary transfer member for transferring a toner image on the image bearing body to the toner image retaining member, and a secondary transfer member for transferring the toner image on the toner image retaining member to the receiving medium.

21. The image forming apparatus as claimed in claim 20, wherein said transfer system brings the primary transfer member and the secondary transfer member into contact against a toner image.

22. The image forming apparatus as claimed in claim 21, wherein said toner further comprises polyolefin.

23. The image forming apparatus as claimed in claim 20, wherein said toner image retaining member is an intermediate transfer belt and said primary and secondary transfer members are transfer rollers.

24. The image forming apparatus as claimed in claim 19 further including a fixing system having a fixing belt for fixing the toner image on the receiving medium.

25. The image forming apparatus as claimed in claim 24, wherein said fixing system further includes a plurality of rollers having the fixing belt trained thereabout, which plurality of rollers include a pair of pressure rollers for pressing the fixing belt against the receiving medium.

26. The image forming apparatus as claimed in claim 25, wherein the binder resin of said toner has a softening point of from 95° to 115° C. and a weight-average molecular weight Mw of from 15000 to 35000.

27. The image forming apparatus as claimed in claim 17, wherein said toner comprises a colored toner.

28. An image forming apparatus comprising:

an electrostatic latent image bearing body for forming an electrostatic latent image on the surface thereof, a developing system for forming a toner image by developing the electrostatic latent image on the electrostatic latent image bearing body, the developing system accommodating a toner comprising a colorant and a binder resin including a polyester resin and polyolefin, a transfer system comprising a toner image retaining member opposing the electrostatic latent image bearing body, a primary transferring unit opposing the electrostatic latent image bearing body via the toner image retaining member for transferring the toner image on the electrostatic latent image bearing body to the toner image retaining member, and a secondary transferring unit opposing the toner image retaining member via a receiving medium for transferring the toner image on the toner image retaining member to the receiving medium, and a fixing system including a fixing belt for fixing the toner image on the receiving medium, wherein said polyester resin has a glass transition point Tg of from 60° to 75° C., a number-average molecular weight Mn of from 3500 to 6000, a ratio of a weight-average molecular weight Mw to the number-average molecular weight Mn (Mw/Mn) ranging from 3 to 8, and a difference between a temperature $T_1$ at the apparent melt viscosity of $1\times10^5$ poise and a temperature $T_2$ at the apparent melt viscosity of $1\times10^6$ poise DT ($=T_2-T_2$) in the range of from 8° to 15° C.

29. The image forming apparatus as claimed in claim 28, wherein said polyolefin has a softening point of from 100° to 150° C.

30. The image forming apparatus as claimed in claim 28, wherein said polyester resin comprises an alcohol component composed of an etherificated diphenol and an acid component composed of an aromatic dicarboxylic acid.

31. The image forming apparatus as claimed in claim 28, wherein said toner image retaining member is an intermediate transfer belt and said primary and secondary transferring units are transfer rollers.

32. The image forming apparatus as claimed in claim 28, wherein said developing system comprises a toner bearing body holding the toner on the peripheral surface thereof for supplying the image bearing body with the toner, and a toner regulating member for regulating the toner on the toner bearing body while charging the same.

33. The image forming apparatus as claimed in claim 32, wherein said toner is a one-component non-magnetic toner.

34. A non-magnetic one-component toner for full-color development comprising:

a colorant, polyolefine wax, and a binder resin having a glass transition point Tg of from 60° to 75° C., a number-average molecular weight Mn of from 3500 to 6000, a ratio of a weight-average molecular weight Mw to the number-average molecular weight Mn (Mw/Mn) ranging from 3 to 8, and a difference between a temperature $T_1$ at the apparent melt viscosity of $1\times10^5$ poise and a temperature $T_2$ at the apparent melt viscosity of $1\times10^6$ poise, DT($=T_1-T_2$) in the range of from 8° to 15° C.

35. The non-magnetic one-component toner for full-color development as claimed in claim 34, wherein said binder resin has a glass transition point Tg of from 63° to 73° C., a number-average molecular weight Mn of from 4000 to 5500, a ratio of a weight-average molecular weight Mw to the number-average molecular weight Mn (Mw/Mn) ranging from 4 to 7, and a difference DT($=T_1-T_2$) in the range of from 8° to 13° C.

36. The non-magnetic one-component toner for full-color development as claimed in claim 34, wherein said binder resin is a polyester resin comprising an alcohol component composed of an etherificated diphenol and an acid component composed of an aromatic dicarboxylic acid.

37. The non-magnetic one-component toner for full-color development as claimed in claim 36, wherein the etherificated diphenol comprises a polyoxyethylene bisphenol A and a polyoxypropylene bisphenol A.

38. The non-magnetic one-component toner for full-color development as claimed in claim 34, wherein said binder resin has a grindability index of from 11 to 28.

39. The non-magnetic one-component toner for full-color development as claimed in claim 34, wherein said colorant is treated by a masterbatch or flushing process.

40. The non-magnetic one-component toner for full-color development as claimed in claim 34 further comprising a charge controlling agent selected from the group consisting of salicylic acid metal acid compounds, calizarene compounds, organic boron salt complex compounds and fluorine-containing quaternary ammonium salt compounds.

41. The non-magnetic one-component toner for full-color development as claimed in claim 40, wherein said charge controlling agent is added in 0.1 to 10 parts by weight per 100 parts by weight of the binder resin.

42. The non-magnetic one-component toner for full-color development as claimed in claim 34 further comprising a post-treatment agent selected from the group consisting of hydrophobic silica, hydrophobic alumina and hydrophobic titania.

43. The non-magnetic one-component toner for full-color development as claimed in claim 42, wherein said post-treatment agent is added in 0.2 to 3 parts by weight against the toner.

44. The non-magnetic one-component toner for full-color development as claimed in claim 34, wherein said binder resin has a softening point of from 95° to 115° C. and a weight-average molecular weight of from 15000 to 35000.

45. The non-magnetic one-component toner for full-color development as claimed in claim 34, wherein said polyolefin wax has a softening point of from 100° to 150° C.

46. The non-magnetic one-component toner for full-color development as claimed in claim 45, wherein said polyolefin wax is an oxygen convertible polyolefin wax having an acid value of from 2 to 30.

47. The non-magnetic one-component toner for full-color development as claimed in claim 34, wherein said polyolefin wax is added in 0.5 to 5.0 parts by weight per 100 parts by weight of the binder resin.

* * * * *